US005415526A

United States Patent [19]

Mercadante et al.

[11] Patent Number: 5,415,526

[45] Date of Patent: May 16, 1995

[54] COOLABLE ROTOR ASSEMBLY

[76] Inventors: Anthony J. Mercadante, 9 Lake St., South Windsor, Conn. 06074; Andrews P. Boursy, 22 Riverview Cir., Marlborough, Conn. 06447

[21] Appl. No.: 155,414

[22] Filed: Nov. 19, 1993

[51] Int. Cl.[6] ..... F01D 5/10

[52] U.S. Cl. ..... 416/190; 416/193 A; 416/500

[58] Field of Search ..... 416/96 R, 190, 193 A, 416/500

[56] References Cited

U.S. PATENT DOCUMENTS

| | | | |
|---|---|---|---|
| 3,056,579 | 10/1962 | Bobo | 416/96 R |
| 3,318,573 | 5/1967 | Matsuki et al. | 253/39.15 |
| 3,709,631 | 1/1973 | Karstensen et al. | 416/95 |
| 3,834,831 | 9/1974 | Mitchell | 416/95 |
| 4,101,245 | 7/1978 | Hess et al. | 416/500 |
| 4,182,598 | 1/1980 | Nelson | 416/193 A |
| 4,455,122 | 6/1984 | Schwarzmann et al. | 416/190 |
| 4,505,642 | 3/1985 | Hill | 416/193 A |
| 4,872,812 | 8/1987 | Hendley et al. | 416/190 |
| 5,143,517 | 9/1992 | Vermont | 416/190 |
| 5,281,097 | 1/1994 | Wilson et al. | 416/500 |
| 5,284,421 | 2/1994 | Chlus et al. | 416/500 |

FOREIGN PATENT DOCUMENTS

| | | | |
|---|---|---|---|
| 1259750 | 1/1972 | United Kingdom | 416/193 A |

*Primary Examiner*—Edward K. Look
*Assistant Examiner*—Mark Sgantzos

[57] ABSTRACT

A rotor assembly 10 having a rotor disk 12 and a plurality of outwardly extending rotor blades 16 is disclosed. Various construction details are developed to provide effective cooling to the platform sections 20 of such rotor blades. In one particular embodiment, a damper 58 engages the underside of the rotor blades 16 and a seal member 42 inwardly of the damper engages the damper to provide damping of vibrations in the rotor blades. Both the damper and the seal member are provided with cooling air holes 42, 74 to positively distribute cooling air collected inwardly of the damper and seal member and to direct the cooling air preferentially between the adjacent platform sections 20 of the rotor blades to effectively cool the rotor blades.

6 Claims, 2 Drawing Sheets

Ar
12
36
2
14
30
24
10
28
26
22
32
34
66b
56
54
64
66c
42
66a
88
86
62
20
2
16
76
17
78
18
84
82

102
42
52
106
104
98
88
64
66a
58
72
68
92
94
74
66b
74
62
66c
86

COOLABLE ROTOR ASSEMBLY

TECHNICAL FIELD

This invention relates to coolable rotor blades of the type used in high-temperature rotary machines, and more specifically, to structure for providing damping to such constructions and for providing cooling fluid to critical locations of the rotor blade.

The concepts were developed in the gas turbine engine industry for use in the turbine section of gas turbine engines, but have applicability to other rotating structures.

BACKGROUND ART

A rotor assembly of the type used in axial flow turbines includes a rotor disk and a plurality of rotor blades extending radially outwardly from the disk. In such constructions, a flowpath for working medium gases extends axially through the rotor assembly and between the rotor blades of the rotor assembly.

Each rotor blade has an airfoil section which extends radially outwardly from the rotor assembly and into the working medium flowpath. The airfoil section adapts the blade to extract energy from the working medium gases for driving the rotor assembly about an axis of rotation. The rotor blade includes a root section which adapts the blade to engage a corresponding slot in the rotor disk. A platform section extends laterally from the blade and is disposed between the root section and the airfoil section to provide an inner boundary to the working medium flowpath.

As the rotor assembly is driven about the axis of rotation by the working medium gases, the gases interact with the rotor blades causing variations in the aerodynamic loading on the rotor blades. The variations in loading induce vibrations in the rotor blades. These vibrations, especially if they increase in magnitude, induce stresses in the rotor blades and adversely effect the fatigue life of the rotor blades.

One example of a construction which provides damping to the rotor blades and sealing to a cavity between adjacent rotor blades is shown in U.S. Pat. No.: 4,455,122 issued to Schwarzmann et al., entitled Blade to Blade Vibration Damper. In this construction, the adjacent blade platforms are separated over at least a portion of this axial length by a gap region. A damper is disposed against the underside of adjacent blade platform sections and a seal is spaced sufficiently close to the damper so as to engage the damper under centrifugal loads to augment damping of the rotor blades by the damper. The damper also blocks the flow of cooling air through the gap region between the adjacent platform sections. Other constructions are shown in U.S. Pat. No.: 3,318,573 issued to Matsuki et al., entitled *Apparatus for Maintaining Rotor Disk of Gas Turbine Engine at a Low Temperature*, U.S. Pat. No.: 3,709,631 issued to Karstensen et al., entitled *Turbine Blade Seal Arrangement, and U.S. Patent No.: 4,872,812 issued to Hendley entitled Turbine Blade Platform Sealing and Vibration Damping Apparatus.*

Still another embodiment is shown in U.S. Pat. No.: 3,834,831 issued to Mitchell entitled *Blade Shank Cooling Arrangement*. In Mitchell, the cavity between adjacent rotor blades is sealed by a plurality of cylindrical buffer segments 44 which may be disposed between the platforms to prevent movement of the blades towards each other and to permit the escape of cooling fluid therethrough.

The above art notwithstanding, scientists and engineers working under the direction of Applicant's assignee have sought to develop effective cooling schemes for supplying cooling air to the critical location between adjacent rotor blades in gas turbine engines.

DISCLOSURE OF INVENTION

This invention is, in part, predicated on the recognition in rotor assemblies of the type shown in U.S. Pat. No.: 4,455,122 (which have a seal inwardly of a sealing damper on the underside of the platform section of a pair of rotor blades) that cooling air supplied to the gap region between the rotor blades is a function of the leakage ratio around the seal and around the damper. In addition, the difference in pressure difference between the gap region and the working medium flowpath on the upstream side of the blade is exceeded greatly by that pressure difference on the downstream side of the blade. This change in pressure difference forces flow out of the gap region in the trailing edge region, pulling replacement flow (hot gases) into the gap region from the working medium flowpath. These hot gases adversely affect the thermal fatigue life of the platform sections. As a result, there is a need to positively supply pressurized cooling air in a predetermined manner to the gap region of the platforms.

According to the present invention, the gap region between adjacent blade platforms is sealed by a blade damper having holes extending therethrough to positively supply pressurized cooling air to the gap region from a cooling air region that receives needed pressurized cooling air through a seal member from another cooling air region that collects the cooling air.

In accordance with the present invention, the cooling air holes in the blade damper are sized to impinge cooling air on the platform sections of the adjacent airfoils.

In accordance with one detailed embodiment of the present invention, the damper has a chordwisely extending rib which extends radially inwardly from the damper and is engaged under operative conditions by the seal member to divide the supply pressure region into at least two cooling air chambers which each receive different amounts of cooling air for distribution to the gap region between the blade platforms.

A primary feature of the present invention is a rotor assembly having a pair of adjacent blade platform sections. The rotor assembly has a first cooling air supply region, a second cooling air supply region which receives needed cooling air from the first region and a gap region which is supplied with metered, pressurized cooling air from the second region. The first region is bounded in part by a seal member having metering holes extending therethrough which places the first region in flow communication with the second region. Another feature is a damper which is disposed between the second cooling air region and the gap region. The damper is spaced radially over a portion of its length from the platform sections, leaving a third cooling air region therebetween. The damper has cooling holes extending therethrough to positively feed cooling air to pre-selected portions of the gap region. The holes are sized to provide impingement cooling to the platform. In one detailed embodiment, a feature is a chordwisely extending rib which extends radially inwardly from the damper. The seal member deflects radially outwardly into contact with the chordwisely extending rib of the damper to provide increased damping and to divide the second cooling air region into a first cooling air chamber and a second cooling air chamber.

A primary advantage of the present invention is the thermal fatigue life of the rotor blade which results from positively cooling the platform section adjacent the gap region between the rotor blades and using the damper and seal member as conduits for directing cooling air to the platform sections of the rotor blade. Another advantage is the engine efficiency for a given level of cooling which results from collecting cooling air in a cavity and metering the cooling air between cooling air regions to positively cool the gap region between adjacent rotor blades. Still another advantage is the cooling effectiveness which results from using a sealing damper to positively supply cooling air to the gap region from two cooling air chambers.

Other features and advantages will be apparent from the specification and claims and from the accompanying drawings which illustrate an embodiment of the present invention.

BEST MODE FOR CARRYING OUT THE INVENTION

Figure 1:
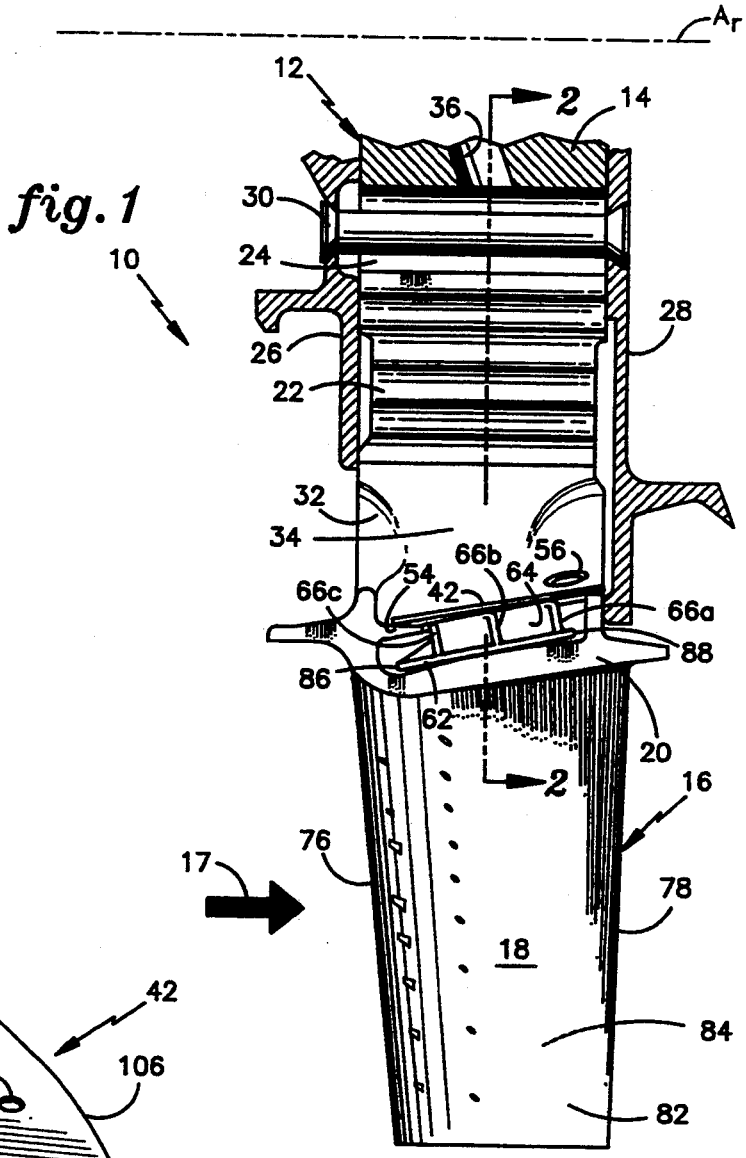
FIG. 1 is a cross-sectional view of a rotor assembly of a gas turbine engine having a rotor disk and a plurality of rotor blades.

FIG. 1 is a side-elevation view, partially in full and partially in section, of a rotor assembly 10 for an axially flow rotary machine, such as gas turbine engine. The rotor assembly has an axis of rotation At. The rotor assembly includes a rotor disk 12 having a rim region 14. A plurality of rotor blades, as represented by the single rotor blade 16, extends outwardly from the rim region of the rotor disk. A flowpath for working medium gases 17 extends axially through the rotor blades.

The rotor blade 16 includes an airfoil section 18, a platform section 20, and a root section 22. A plurality of blade attachment slots, as represented by the blade attachment slot 24, are disposed in the rim region 14. Each blade attachment slot is spaced circumferentially from the adjacent blade attachment slot and adapts the rotor disk to receive the root section of an associated rotor blade.

A front side plate 26 and a rear side plate 28 are disposed axially with respect to the rotor blade, to trap the rotor blade on the rotor disk. Means for axially securing the side plates to the rotor disk, as represented by the rivet 30, urge the front side plate in the axially downstream direction against the rotor disk, and the rear side plate in the axially upstream direction against the rotor disk.

The root section 22 of the rotor blade includes an extended neck portion 32 which raises the rotor blade above the disk to the flowpath for working medium gases. The root sections of adjacent rotor blades are spaced circumferentially, leaving a cooling air cavity 34 therebetween.

Figure 2:
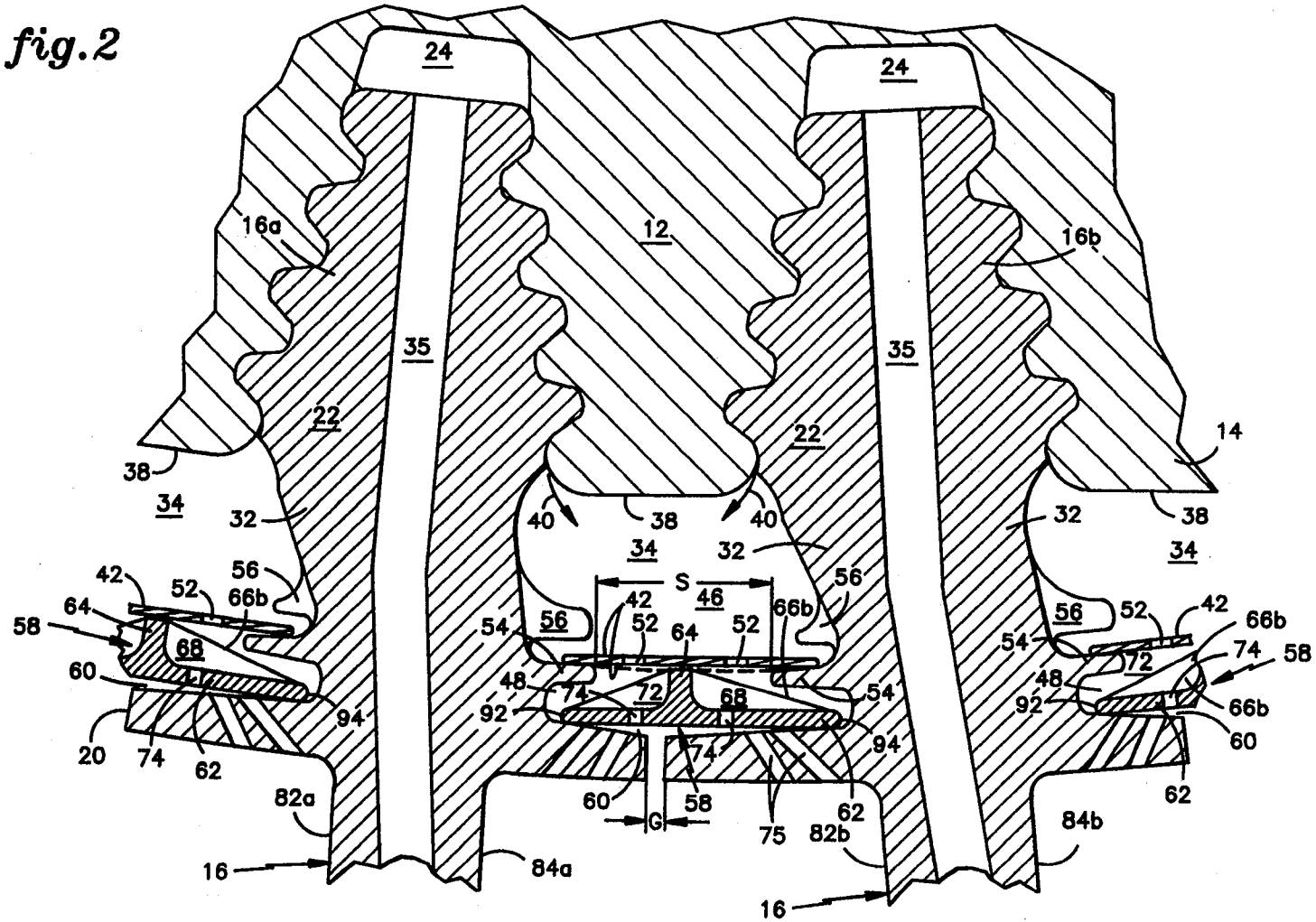
FIG. 2 is a sectional view of a portion of the rotor assembly shown in FIG. 1, taken along the lines 2—2 of FIG. 1.

The rotor blades are typically cooled and have passages as shown in FIG. 2 as passage 35 extending internally of the blade from the root section 22 to the airfoil section 18 for flowing cooling air through the blade. A source of cooling air, such as a conduit or a hole 36 in the disk, provides cooling air to the root section of the rotor blade. A portion of the cooling air leaks both radially and axially across the interface between the blade root section and the corresponding disk slot and into the cavity 34.

FIG. 2 is a cross-sectional view of a portion of the rotor assembly shown in FIG. 1 and is taken along the lines 2—2 of FIG. 1. A rim surface 38 extends between the root sections 22 of adjacent rotor blades **16*a*, 16*b*. The cavity 34 is bounded by the outwardly facing rim surface 38**.

The platform section 20 of each airfoil extends laterally from the airfoil section 18 and from the root section 22 into close proximity with the platform section of the adjacent rotor blades, leaving a gap region G therebetween. The platform sections are spaced radially from the rim surface 38 and, in cooperation with the neck portion 32 of the root sections, bound the cooling air cavity 34. A leak path, as represented by the flowpath 40, extends through the interface between the root section and the rotor disk to place the cooling air supply conduit 36 in flow communication with the cooling air cavity 34.

A plate-like seal member 42 extends axially across the gap S between adjacent rotor blades to divide the cooling air cavity 34 into a first cooling air region 46 and a second cooling air region 48. A plurality of cooling air holes 52 extend radially through the seal member to place the first cooling air region 46 in flow communication with the second cooling air region 48. The seal member is formed of a flexible sheet metal construction. The material has a thickness such that, given the span S between adjacent rotor blades, this seal member is deflectable in the radial direction in response to rotational forces under operative conditions.

The root section of each rotor blade has a first protrusion 54 spaced radially inwardly from the platform section 20, leaving the second region 48 therebetween. A second protrusion 56 is spaced radially inwardly from the first protrusion, leaving a space therebetween to trap radially the plate-like seal member 42.

A damper 58 extends across the second region 48 to engage the adjacent platform sections. The damper provides a radial outward seal to the second region 48 and is spaced radially inwardly from a portion of each platform section 20, leaving a third cooling air region 60 therebetween. The third cooling air region extends to include the gap region G between the spaced apart portions of the platform sections.

The damper 58 includes a seal plate 62 and at least one rib, such as the chordwisely extending rib 64. The damper includes at least one laterally extending rib 66. Two other lateral ribs **66*b*, 66*c* are broken away in FIG. 2 and shown in FIG 3.. The ribs extend radially to reinforce the damper. In alternate constructions, the laterally extending rib 66*c*** might divide the second region into a forwardly disposed cooling air chamber and a rearwardly disposed cooling air chamber.

In the embodiment shown, the chordwisely extending rib 64 divides the second cooling air region 48 into a first cooling air chamber 68 and a second cooling air chamber 72. A plurality of cooling air holes 74 places the first cooling air chamber 68 and the second cooling air chamber 72 in flow communication with the third cooling air region 60 of the rotor assembly. The cooling air holes 74 are sized to direct the flow of cooling air toward and against the underside of the platform. Accordingly, the cooling air holes 74 are referred to as "impingement" cooling air holes.

Each platform section 20 of the rotor blade has a plurality of cooling air holes 75 which extend through the platform section to place the third cooling air region 60 in flow communication with the surface of the platform section. These cooling air holes extend through the surface of the platform section adjacent the airfoil sections of the rotor blade.

As shown in FIG. 1, each airfoil section has a leading edge 76 and a trailing edge 78. The airfoil section has a pressure surface 82 which extends from the leading edge to the trailing edge on one side of the airfoil and a suction surface 84 which extends from the leading edge to the trailing edge on the other side of the airfoil. The pressure surface and the suction surface provide the aerodynamic surfaces to the airfoil and also provide a reference for discussion of the configuration of the seal member 42 and damper 58. The adjacent rotor blades 16*a*, 16*b* have respectively surfaces 82*a*, 84*a*, 82*b*, 84*b*.

Figure 3:
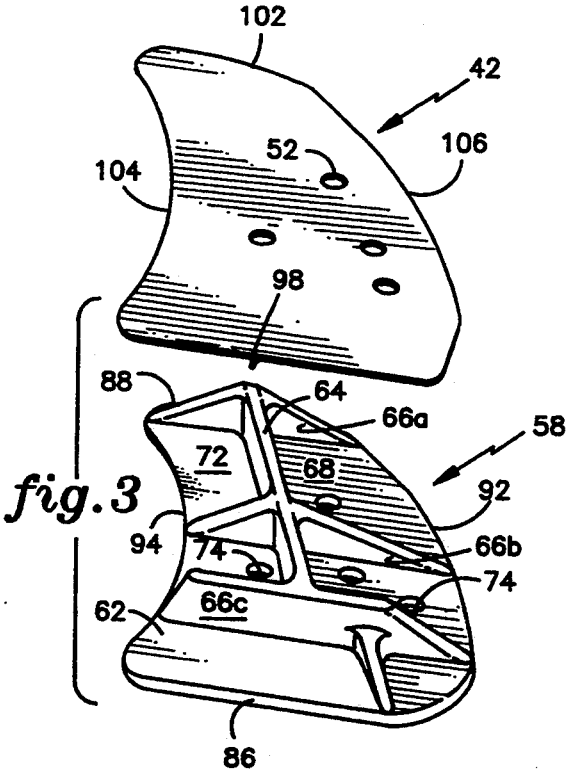
FIG. 3 is an exploded perspective view illustrating a damper and seal of FIG. 2.

FIG. 3 is an exploded perspective view illustrating the seal member 42 and the damper 58 shown in FIG. 1 and FIG. 2. The damper has a leading edge 86 and a trailing edge 88. A first side 92 is in close proximity to the pressure surface 82*b* of one rotor blade 16*b* and a second side 94 extends in close proximity to the suction surface 84*a* of the adjacent rotor blade 16*a*. As can be seen, more impingement cooling holes 74 extend through the damper adjacent the pressure surface than extend through the damper adjacent the suction surface.

The seal member 42 also has a leading edge 98, a trailing edge 102, a suction side 104, and a pressure side 106. The holes 52 through the seal are disposed in close proximity to the holes in the damper in the radial direction. In some cases, the alignment may provide a partial line of sight communication between the first cooling air region 46 and the third cooling air region 60.

During operation of the rotor assembly 10 shown in FIG. 1, the rotor assembly is driven about its axis of rotation Ar at high rotational speeds. Rotational forces acting on the damper 58 and on the seal member 42 urge these members outwardly against the rotor assembly 10. The damper presses tightly against the underside of the blade platform sections 20 and the seal member 42 deflects outwardly against the rib 64 of the damper. Frictional forces between the seal member and the damper and between the damper and the blade platforms provide coulomb damping to the rotor assembly. This damping dissipates vibrational energy in the rotor blades, reducing the adverse effect that such vibrations have on the fatigue life of the airfoils. The chordwisely extending rib 64 and the laterally extending ribs 66*a*, 66*b*, 66*c* reinforce the damper against deflections in unwanted directions. Avoiding these deflections ensures the damper is spaced away from the platform sections of the rotor blades, leaving unobstructed the cooling air holes 75 extending through the platform sections.

Cooling air is flowed via the conduit 36 to the interior of the rotor blade 16 and is thence discharged into the working medium flowpath 17. The cooling air blocks the transfer of heat to the airfoil through film cooling, especially in critical regions of the airfoil, and carries heat away from the airfoil. Cooling air is also flowed through the leak path 40 to the first cooling air region 46. The cooling air is discharged from the cooling air region 46 via the metering holes 52 in the seal member 42 into the second cooling air region 48. The cooling air is divided between the first cooling air chamber 68 and the second cooling air chamber 72. Cooling air is discharged from these chambers 68, 72 via the impingement holes 74 against the platform sections of the airfoils, increasing the convective heat transfer coefficient associated with the cooling process. This effective use of the cooling air decreases the amount of cooling air for a given level of cooling of the platform section, and thus decreases any adverse effect that the use of cooling air has on the efficiency of the engine.

The cooling air holes 74 are sized and located to provide cooling to the critical regions of the platform section 20. The volume of cooling air is such that the large pressure difference between the third cooling air region 60 at the trailing edge 78 of the blade and the working medium flowpath 17 does not draw large amounts of cooling air from the third region at the leading edge region of the rotor assembly. In addition, the leading edge portion of the third region is positively supplied with cooling air. Accordingly, hot working medium gases from the flowpath are blocked from entering the gap region G between the adjacent blade platform sections 20. This avoids over-temperaturing these sections of the airfoil and avoids cracking and other heat-related damage to the platform section of the airfoil.

In addition, dividing the second cooling air region into a first chamber 68 and a second chamber 72 allows for flexibility in distribution of the cooling air to the platform sections 20 of the adjacent blades. As will be realized, adjustments may be easily made after gaining operational experience with the engine. For example, experience may suggest redistributing the cooling air or increasing or decreasing the volumes of cooling air. This is simply accomplished by minor modifications to the seal member and the damper or to the seal member or the damper alone.

Although the invention has been shown and described with respect to detailed embodiments thereof, it should be understood by those skilled in the art that various changes in form and detail thereof may be made without departing from the spirit and scope of the claimed invention.

We claim:

1. A rotor assembly for an axial flow rotary machine, the rotor assembly having an axis of rotation Ar, a source of cooling air, and a flowpath for working medium gases extending axially therethrough, which comprises:

a rotor disk having a rim region which extends circumferentially about the rotor disk;

a plurality of coolable rotor blades each rotor blade having an airfoil section which extends radially outwardly from the rotor assembly into the flowpath for working medium gases, a platform section extending laterally from the airfoil section into close proximity with the platform section of the adjacent rotor blade, the platform section being spaced radially from a portion of the rim region leaving a cooling air cavity therebetween which is in flow communication with the source of cooling air and having a lateral region which extends between at least a portion of the adjacent platform sections, a root section which extends radially inwardly from the platform section to engage the rotor disk;

a seal member which extends laterally between a pair of adjacent blades to divide the cooling air cavity into a first region and a second region, the seal member having a plurality of cooling air holes which extend through the seal member to place the first region in flow communication with the second region; and, a damper having a seal plate which extends between adjacent rotor blades to bound the second region and which is spaced radially inwardly over at least a portion of the damper front the adjacent blade platform sections leaving a third cooling air region between the portion of the damper and the adjacent blade platform section which includes the lateral region between adjacent platform sections, the damper having a plurality of cooling air holes which extend through the seal plate to place the second region in flow communication with the third region;

wherein under operative conditions the pressure of the air in the cooling air cavity is greater than the pressure of the working medium gases outwardly of the rotor blades, wherein the holes extending through the seal member place the first cooling air region in flow communication with the second cooling air region, and the holes extending through the damper positively supply cooling air from the second region to the third region to pressurize the third region against entry of the working medium gases into the third region.

2. The rotor assembly as claimed in claim 1 wherein the cooling air holes extending through the damper are sized to impinge cooling air on the underside of the blade platform sections.

3. The rotor assembly as claimed in claim 1 wherein the damper has a seal plate which engages the underside of the adjacent blade platforms and the cooling air holes of the damper extend through the seal plate, and wherein a rib extends inwardly from the seal plate to guide the flow of cooling air between the cooling air holes.

4. The rotor assembly as claimed in claim 3 wherein the seal member is sufficiently close to the damper as to deflect into engagement with the damper in response to rotational forces acting on the seal member under operative conditions and wherein the engagement between the seal member and the rib of the damper divides the second region into a first cooling air chamber and a second cooling air chamber.

5. The rotor assembly as claimed in claim 4 wherein the rib extends chordwisely on the seal plate and wherein the cooling air holes extending through the seal plate are sized to impinge cooling air on the underside of the blade platform sections.

6. A rotor assembly for an axial flow rotary machine, the rotor assembly having an axis of rotation Ar, a source of cooling air, and a flowpath for working medium gases extending axially therethrough, which comprises:

a rotor disk having a rim region which extends circumferentially about the rotor disk, and which has a plurality of blade attachment slots disposed in the rim region, each of which is spaced circumferentially from the adjacent blade attachment slot leaving an outwardly facing rim surface therebetween;

a plurality of coolable rotor blades, one at each blade attachment slot, each rotor blade having an airfoil section which extends radially outwardly from the rotor assembly into the flowpath for working medium gases, the airfoil section including a leading edge, a trailing edge, and a suction surface and a pressure surface which each extend from the leading edge to the trailing edge;

a platform section extending laterally from the airfoil section into close proximity with the platform section of the adjacent rotor blade, the platform section being spaced radially form the rim surface leaving a cooling air cavity therebetween which is in flow communication with the source of cooling air, a root section which extends radially inwardly from the platform section to engage the rotor disk, the root section of each pair of adjacent rotor blades including an extended neck region bounding the cooling air cavity and having a first protrusion spaced radially inwardly from the platform section leaving a first space therebetween which adapts the rotor blade to trap a damper and a second protrusion spaced radially inwardly from the first protrusion leaving a second space therebetween which adapts the rotor blade to trap a seal member in the gap;

a seal member disposed in the second space which extends between a pair of adjacent blades to divide the cooling air cavity into a first region and a second region, the seal member having a leading edge, a trailing edge, and a suction side and a pressure side which each extends from the leading edge to the trailing edge, and a plurality of cooling air holes which extend through the seal member to place the first region in flow communication with the second region, the seal member having more holes in closer proximity to the pressure side than to the suction side; and, a damper disposed in the first space which extends between adjacent rotor blades to bound the second region and which is spaced radially inwardly over at least a portion of the damper from the adjacent blade platform sections leaving a third cooling air region between the portion of the damper and the adjacent blade platform section, the damper having a seal plate which has a leading edge, a trailing edge, and a suction side and a pressure side which each extend from the leading edge to the trailing edge, a first chordwisely extending rib which divides the suction side from the pressure side, and a second laterally extending rib which extends between the suction side and the pressure side, a plurality of cooling air holes which extend through the seal plate to place the second region in flow communication with the third region, the cooling air holes being disposed rearwardly of the laterally extending rib and being divided by the chordwisely extending rib, the seal plate having more holes in closer proximity to the pressure side than to the suction side; wherein the seal member is sufficiently close to the damper as to deflect into engagement with the damper in response to rotational forces acting on the seal member under operative conditions and wherein the engagement between the seal member and the chordwisely extending rib divides the second region into a first cooling air chamber and a second cooling air chamber, and wherein the holes extending through the seal plate of the damper positively supply cooling air to the third region from the two chambers and are sized to impinge cooling air on the underside of the blade platform sections.

* * * * *

UNITED STATES PATENT AND TRADEMARK OFFICE

CERTIFICATE OF CORRECTION

PATENT NO. : 5,415,526
DATED : May 16, 1995
INVENTOR(S) : Anthony J. Mercadante, et. al.

It is certified that error appears in the above-indentified patent and that said Letters Patent is hereby corrected as shown below:

Title page, item [76] inventors: should read as following--

Anthony J. Mercadante, 9 Lake St.,
South Windsor, Conn. 06074;
Andrew P. Boursy, 22 Riverview
Cir., Marlborough, Conn. 06447--

Signed and Sealed this

Twenty-second Day of August, 1995

Bruce Lehman

*Attest:*

BRUCE LEHMAN

*Attesting Officer*

*Commissioner of Patents and Trademarks*